US010495099B2

(12) United States Patent
Svarre et al.

(10) Patent No.: US 10,495,099 B2
(45) Date of Patent: Dec. 3, 2019

(54) MULTISTAGE CENTRIFUGAL PUMP WITH SHAFT HYDRAULIC FORCE COMPENSATION

(71) Applicant: GRUNDFOS HOLDING A/S, Bjerringbro (DK)

(72) Inventors: Erik Bundesen Svarre, Bjerringbro (DK); John Frigård Nielsen, Fårup (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 296 days.

(21) Appl. No.: 15/355,744

(22) Filed: Nov. 18, 2016

(65) Prior Publication Data

US 2017/0146019 A1 May 25, 2017

(30) Foreign Application Priority Data

Nov. 19, 2015 (EP) ..... 15195416

(51) Int. Cl.

| | |
|---|---|
| ***F04D 29/12*** | (2006.01) |
| ***F04D 29/041*** | (2006.01) |
| ***F04D 29/051*** | (2006.01) |
| ***F04D 29/042*** | (2006.01) |
| ***F04D 29/10*** | (2006.01) |

(Continued)

(52) U.S. Cl.

CPC ..... *F04D 29/126* (2013.01); *F04D 1/06* (2013.01); *F04D 29/041* (2013.01); *F04D 29/042* (2013.01); *F04D 29/0413* (2013.01); *F04D 29/0416* (2013.01); *F04D 29/051* (2013.01); *F04D 29/0513* (2013.01); *F04D 29/0516* (2013.01); *F04D 29/086* (2013.01);

(Continued)

(58) Field of Classification Search

CPC .. F04D 29/122; F04D 29/041; F04D 29/0413; F04D 29/0416; F04D 29/042; F04D 29/051; F04D 29/0513; F04D 29/0516; F04D 29/086; F04D 29/106; F04D 29/12

See application file for complete search history.

(56) References Cited

U.S. PATENT DOCUMENTS

| | | | | |
|---|---|---|---|---|
| 1,927,543 | A | 9/1933 | Boyle | |
| 10,094,388 | B2 * | 10/2018 | Keller | F04D 29/041 |

(Continued)

FOREIGN PATENT DOCUMENTS

| | | | |
|---|---|---|---|
| NL | 7 712 699 | A | 5/1979 |
| WO | 9943959 | A2 | 9/1999 |

*Primary Examiner* — Christopher S Bobish
(74) *Attorney, Agent, or Firm* — McGlew and Tuttle, P.C.

(57) ABSTRACT

A multistage centrifugal pump (1) has impellers (9) arranged on a common shaft (8), which is rotatably arranged within a pump casing (2-4). One end of the shaft (8) is led out of the casing (2-4) for connection to a drive motor and another shaft end (15) is rotatably mounted in the pump casing (2-4). The shaft end (15) which is mounted within the pump casing (2-4) is subjected to a counter-force which is produced by way of pressure subjection via a conduit connection to a delivery side of the pump. An axial seal (11) is provided on the shaft end (15) arranged within the pump casing (2-4). The rotating part of the axial seal is led on the shaft end and the non-rotating part is led, axially movably, within the pump casing (2-4). A sealing arrangement is provided between the pump casing and the axially movably mounted part.

15 Claims, 7 Drawing Sheets

(51) Int. Cl.
*F04D 29/08* (2006.01)
*F04D 1/06* (2006.01)

(52) U.S. Cl.
CPC ..... *F04D 29/106* (2013.01); *F04D 29/12* (2013.01); *F04D 29/122* (2013.01)

(56) References Cited

U.S. PATENT DOCUMENTS

2008/0080988 A1* 4/2008 Wahl ..... F04D 13/0653
417/365
2008/0267763 A1* 10/2008 Wahl ..... F04D 29/582
415/4.5
2017/0130730 A1* 5/2017 Torkildsen ..... F04D 29/051

* cited by examiner

MULTISTAGE CENTRIFUGAL PUMP WITH SHAFT HYDRAULIC FORCE COMPENSATION

CROSS REFERENCE TO RELATED APPLICATIONS

This application claims the benefit of priority under 35 U.S.C. § 119 of European Application 15 195 416.1 filed Nov. 19, 2015, the entire contents of which are incorporated herein by reference.

FIELD OF THE INVENTION

The invention relates to a multi-stage centrifugal pump with which the impellers of the pump stages are arranged on a shaft which is rotatably arranged within a pump casing and which at one end is led out of the casing for connection to a drive motor and at the other end is arranged within the pump casing.

BACKGROUND OF THE INVENTION

With multi-stage centrifugal pumps, with which the impellers of the pump stages are arranged on a common shaft and are rotatably arranged within a pump casing, the drive is often effected via an external motor which is drivingly connected to the pump shaft by a coupling and is received and fastened on a motor stool, which is to say a casing part which is designed for receiving the motor. For this, the one shaft end is sealingly led through the pump casing and out of this, and the other shaft end is mounted within the pump casing. Thereby, it is counted as belonging to the state of the art to accommodate the forces acting upon the pump shaft by way of the motor bearings and to merely provide a radial guiding, for example by way of shaft sleeves which are arranged in the region of the pump stages, within the pump casing. In contrast, the pump-side shaft end is mounted radially and/or axially within the pump casing, in order to relieve the motor bearings, in the case of larger multi-stage pumps. Common to all designs however is an increased loading and thus an increased wear of the motor bearings.

Thereby, it is counted as belonging to the state of the art, to compensate these axial forces upon the shaft which result due to the hydraulic forces, be it by way of subjecting the shaft end mounted in the casing to the pressure of the delivery side or by way of the provision of recesses in the shrouds of the impellers. The latter results in a significant loss in the efficiency, on account of the backflows which are caused by way of this. With hydraulic force compensation, there exists the problem that a highly-loaded seal is to be provided between the rotating shaft end and the stationary casing, which, if it has a good sealing effect, creates a high friction and thus also a high wear and leads to overflow losses given the degradation of the sealing effect.

SUMMARY OF THE INVENTION

Against this state of the art, it is an object of the present invention, to design a multi-stage centrifugal pump of the known type, such that on the one hand the hydraulically caused forces upon the shaft can be reduced, but on the other hand a good, low-friction and low-wear sealing, which is therefore stable over the long term, is effected.

With the multi-stage centrifugal pump according to the invention, the impellers of the pump stages are arranged on a shaft in a direct manner or via a carrier body, said shaft being rotatably arranged within a pump casing. This shaft, at one end, is led out of the casing in a sealed manner for connection to a drive motor and at the other end this shaft is arranged within the pump casing. The shaft end arranged within the pump casing is subjected to a counter-force which is produced by way of pressure subjection via a conduit connection to a delivery side of the pump, typically, but not necessarily to the pressure of the last pump stage, thus the delivery side of the pump. According to the invention, an axial seal is provided on the shaft end which is mounted within the pump casing, a rotating part of said axial seal being led on the shaft end and a non-rotating part of the axial seal being led within the pump casing in an axially movable manner. Thereby, according to the invention, a sealing means (a sealing device) is provided between the non-rotating, axially movably mounted part and the pump casing, in order there to prevent a flow of fluid from the delivery side over to the suction side. A pump casing in the context of the present invention is also to be understood as an intermediate component which is integrated into the pump casing and on which the sealing means engage.

A basic concept of the solution according to the invention, on the one hand is to provide a hydraulic force compensation which reduces the axial forces of the pump shaft acting upon the bearings, but on the other hand to provide an axial seal which only has a low friction and thus a low wearing, but which is simple in construction and reliable with regard to its effect, on the shaft end mounted within the casing. This is achieved by way of the rotating part of the axial seal being provided on the shaft end, and the non-rotating part within the pump casing. However, the non-rotating part of the axial seal is advantageously mounted and guided within the pump casing in an axially movable manner, in order be able to compensate possible wear or axial play of the shaft, wherein sealing means are provided between the axially movably mounted part of the axial seal and the pump casing. The complete sealing is thus divided into a purely axial seal as well as a further seal, preferably a radial seal, wherein the predominant movement is accommodated in the region of the axial seal, whereas the other, in particular radial seal only has to carry out small axial movements and thus, inherent of the design, is only subjected to low wear. This further, in particular radial seal can therefore be formed inexpensively, for example by way of an elastic sealing ring, whereas the axial seal can be designed exclusively for sealing with respect to the rotation movement, by way of suitably designed sealing surfaces. Thereby, given a suitable design of the axial seal, this can also accommodate axial forces and thus assume the function of a thrust bearing.

According to the invention, one envisages subjecting the shaft end which is mounted within the pump casing to the pressure of the delivery side, in order in particular to largely compensate the axial forces resulting due to the hydraulic forces. However, the design according to the invention in a particularly advantageous manner envisages the sealing not being effected by a seal between a stationary and a rotating component, but between the pump casing and the axially movably mounted and non-rotating part of the axial seal. This solution has the advantage that the seal merely needs to accommodate the typically slight axial movement of the non-rotating part of the axial seal, but not the friction-intensive and wear-creating movement to the rotating part and which is accommodated by the axial seal. Inasmuch as this is concerned, the sealing is effected by the sealing gap itself, which, given suitably dimensioned axial seal, is sufficiently small so as to be able to neglect overflow losses.

The sealing means can therefore be designed in an inexpensive manner and in a manner which is stable over the longer term, without this having a noticeable influence on the efficiency of the pump.

The solution according to the invention also has the advantage that axial forces of the shaft can be accommodated by the axial seal in the pump casing, at least to a limited measure. The significant part of the axial forces however is produced by the hydraulic compensation, which means the leading of the pressure level produced by the pump, back onto the free shaft end within the pump casing, so that the drive of the pump can be ensured by a standardized motor, irrespectively of the stage number. The dynamic force compensation of the hydraulically caused axial forces acting upon the shaft limits the forces to be accommodated by the thrust bearing to a minimum. The hydraulic force compensation also has the advantage that a force compensation is also not effected in the case of a dry running, when these restoring forces do not occur, so that even then the wearing is kept to within acceptable limits.

The design according to the invention moreover has the advantage that with a suitable design implementation, the axial seal as well as the remaining sealing means, in particularly the radial seal, can be exchanged without having to remove the shaft out of the pump casing. Pump stages, which is to say the impellers with the associated diffusers can therefore also remain in their designated position.

It is particularly advantageous if the non-rotating part of the axial seal is subjected to the pressure of the delivery side of the pump, at the axial side of this non-rotating part which is away from the sealing surface, thus rear side. The necessary support force for the axial seal or for the thrust bearing function is mustered by way of this, and specifically in a dynamic manner, which is to say in dependence on the exit pressure of the pump.

This can advantageously be developed further by way of the non-rotating part of the axial seal comprising a ring, whose one axial face side forms a sealing surface of the axial seal and whose other axial side which is away from this, thus the rear-side axial side is configured in a closed manner and comprises at least one recess, whose pressure-effective cross-sectional area is smaller than the pressure-effective cross-sectional area of the conduit connection to the delivery side. Thereby, a recess in the context of the present invention can be an edge gap, an opening, one or more through-holes or a combination thereof. What is essential is the fact that the pressure-effective cross-sectional area of the one or more recesses is always smaller than the pressure-effective cross-sectional area of the one or the several conduit connections to the delivery side, in order to ensure that a pressure firstly forms in front of this closed surface of the ring on starting operation of the pump, and this pressure leads to the ring moving axially in the direction of the counter-sealing surface at the shaft end, and this additional axial force creating the movement of the ring only decreasing when the interior delimited by the ring is completely filled with fluid after a certain time.

An O-ring which is held in a radially peripheral groove is advantageously provided for sealing the axially movable part of the axial seal and the pump casing or the component which is provided within the pump casing for receiving the axially movable part. This radially peripheral groove can either be provided on the casing side or ring side, thus bearing side. Such an O-ring is inexpensive, simple to assemble and exchange as the case may be, and forms a reliable seal over the longer term.

It is particularly advantageous if the O-ring lies in a peripheral groove which is provided on the inner side of a holding ring and which is fixed in the pump casing. Such a design, with which the O-ring is not led directly in the pump casing, but in an intermediate component, has the advantage that here only the holding ring needs to be machined in a material-removing manner, and the holding ring for example is integrated by way of pressing into the pump casing, and no chucking of the pump casing on manufacture of the groove is necessary inasmuch as this is concerned.

The non-rotating part of the axial seal can be formed from a solid material, for example as a turned part, in order to form the closed axial side of this part. However, it is particularly advantageous if this part is formed as a ring from a tube section, and the closed axial side can be created by a sheet-metal section which can be inexpensively manufactured by way of punching. This sheet-metal section which covers the ring at the rear side and thus forms the initially pressure-effective closed axial side with the at least one recess, can moreover be advantageously utilized, in order to form the rotation lock of the non-rotating part of the axial seal, in particular of the ring and to fix this in a rotationally fixed manner either on the holding ring and/or on the pump casing. Since only small forces are to be accommodated inasmuch as this is concerned, this function can also be realized by way of an inexpensive punched part which as the case may be is likewise machined in a shaping manner.

According to the invention, one envisages connecting a holding ring in a sealed and fixed manner to the shaft end, at the shaft side, wherein this holding ring is either itself configured as a sealing ring and forms an axial sealing surface or advantageously receives a rotating ring forming the axial sealing surface. Such a rotating ring for example can consist of a highly wear-resistant silicon carbide, wherein the holding ring can consist of a less expensive, preferably metallic material. Thereby, the rotating ring forming the axial sealing surface can advantageously be fixed on the holding ring or with this holding ring by way of a threaded sleeve which is screwed into the holding ring, or by a sleeve. This permits the exchange of the rotating ring forming the axial sealing surface, likewise without a disassembly of the shaft, since the free end of the shaft is accessible from outside the pump casing and can be blocked from rotating by way of a tool.

The centrifugal pump according to the invention is advantageously configured as an inline pump, thus comprises a pump casing with which the suction connection and delivery connection are arranged on the same axis. A channel between the delivery connection and a space which receives the non-rotating part of the axial seal and is typically arranged in the foot of the pump casing can be realized in a simple manner with such an arrangement. Several channels can also be provided as the case may be, in order to realize the required conduit cross sections.

One of the sealing surfaces of the axial seal is advantageously configured as a three-point contact, thus comprises three macroscopic prominences which are distributed over the periphery, and which one the one hand ensure a defined contact to the plane counter-sealing surface and on the other hand are particularly advantageous with regard to the build-up of a lubricant film, wherein this lubricant film should be built up as rapidly as possible on starting up the pump, so that the advantageous and low-wear sliding friction arises. The design of this three-point contact is effected advantageously on the rotating ring, since this as a separate component can be machined less expensively with a lower tolerance than the remaining components.

The design according to the invention permits the axial mounting of the shaft to be provided exclusively at the motor side, wherein the axial forces which thereby occur are so small inherently of the design, that they can be accommodated by the motor bearings, without noticeably increasing their wear. The axial mounting of the shaft is therefore advantageously effected by way of one or more bearings which are arranged on the motor side, preferably a motor-side bearing close to the pump-side end of the motor shaft.

According to an advantageous further development of the invention, the ring of the non-rotating part of the axial seal can alternatively or additionally be constructed in a multi-part manner and comprise a highly wear-resistant part having the sealing surface, as well as a carrier receiving the highly wear-resistant part, as has already been specified above for the rotating part of the axial seal.

The rotating ring and/or the highly wear-resistant part of the ring can advantageously be formed of silicon carbide or a comparably highly wear-resistant material, which permits particularly long service lives.

According to an advantageous further development of the invention, a closable opening can be provided in the pump casing, preferably aligned to the axial seal, through which opening the axial seal can be exchanged, in order to be able to exchange the axial seal and the sealing means between the non-rotating part of the axial seal and the pump casing, without having to disassemble the pump.

The invention is hereinafter explained in more detail by way of embodiment examples represented in the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
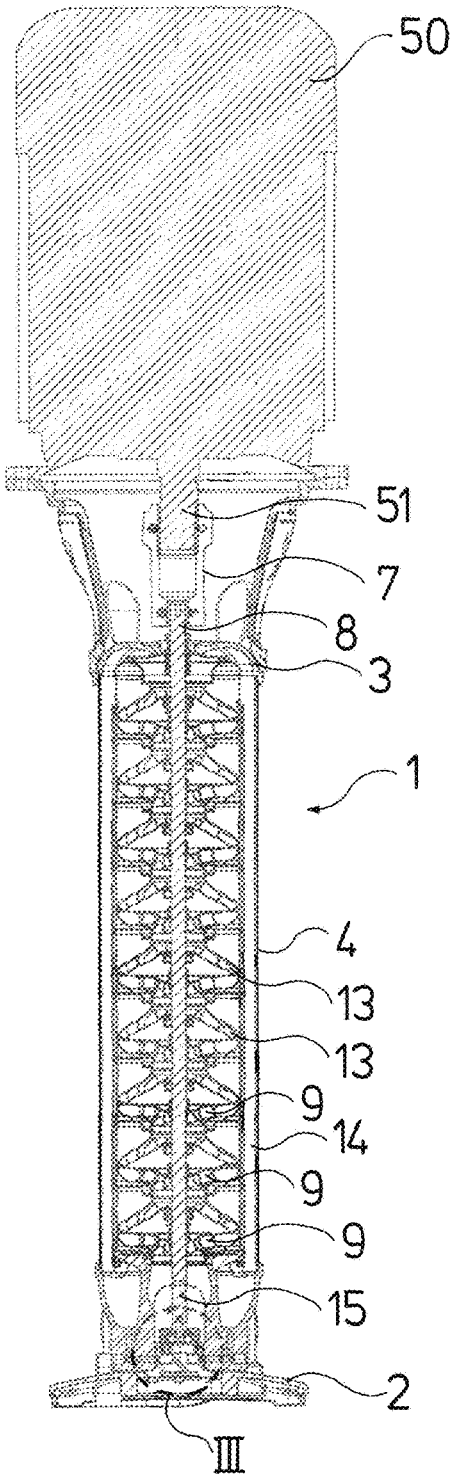
FIG. 1 is a greatly simplified schematic, longitudinal, sectional view through a multi-stage centrifugal pump of the inline construction type with a drive motor.
Figure 2:
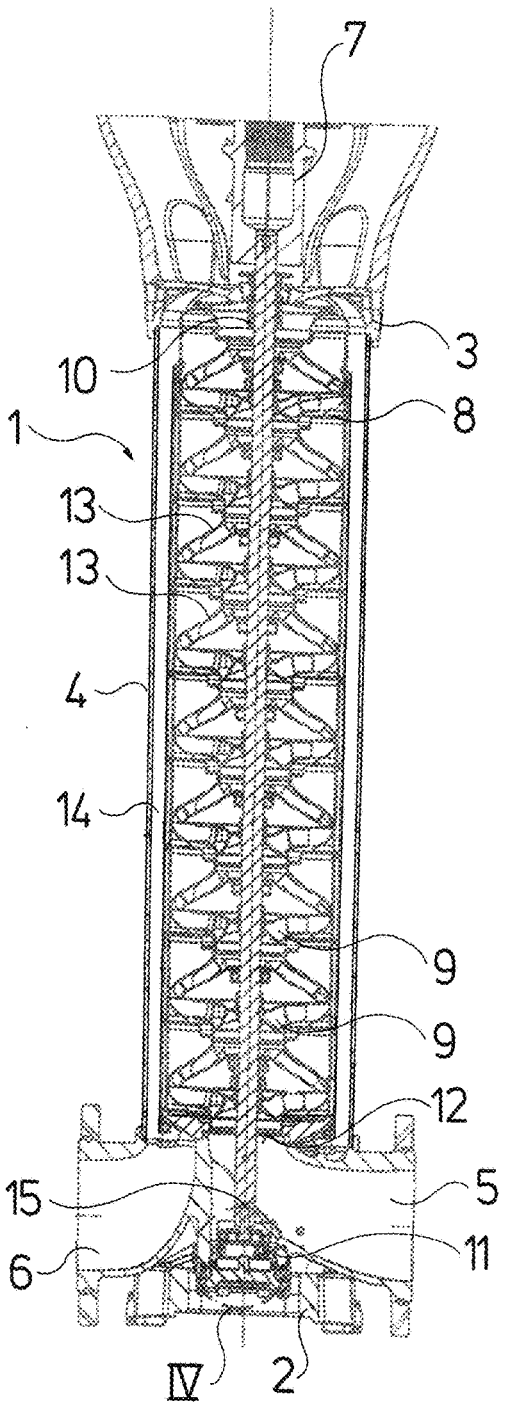
FIG. 2 is an enlarged longitudinal, sectional view of the pump which is rotated by 90° with respect to FIG. 1.
Figure 3:
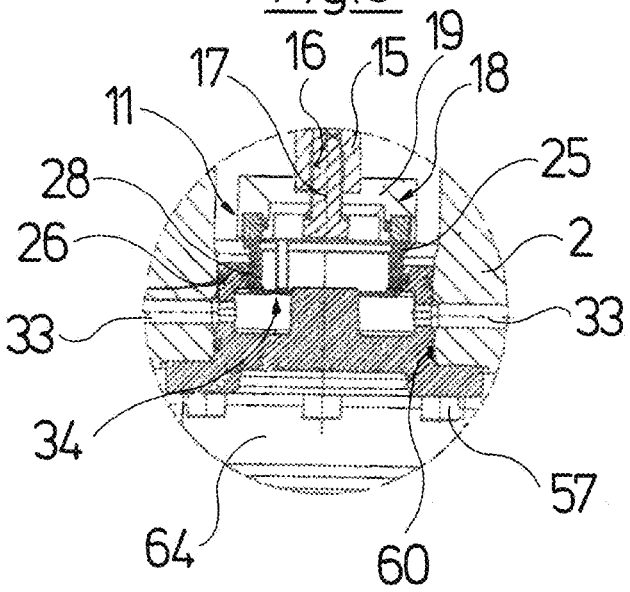
FIG. 3 is an enlarged view of the detail III in FIG. 1.
Figure 4:
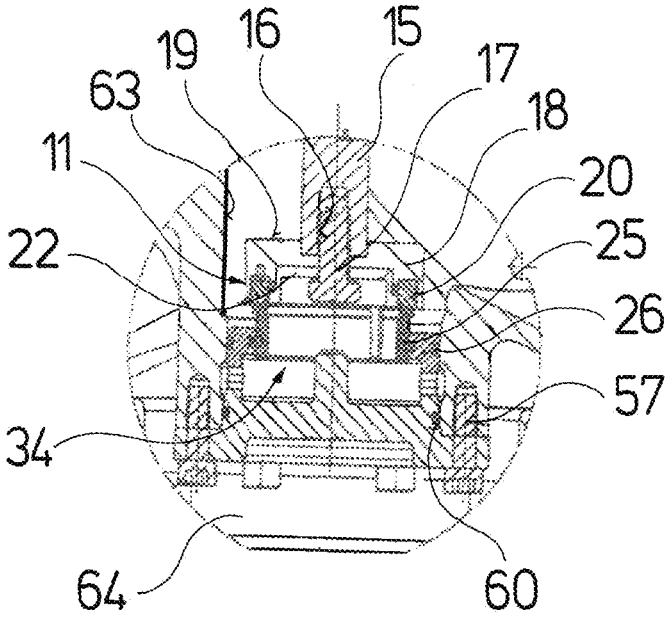
FIG. 4 is an enlarged view of the detail IV in FIG. 2.
Figure 5:
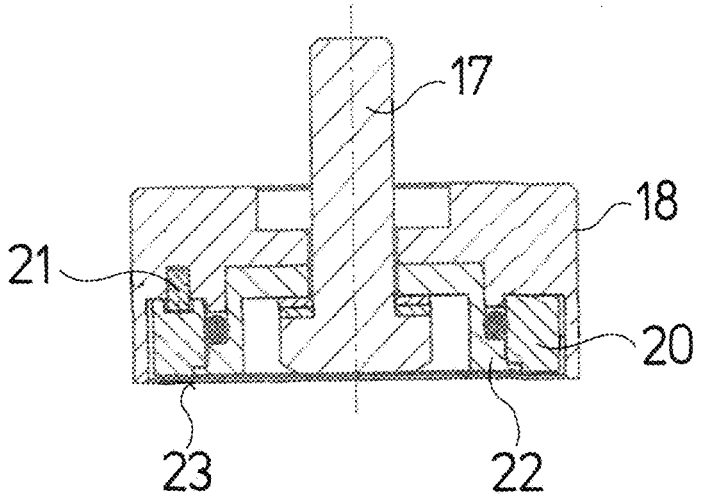
FIG. 5 is a longitudinal, sectional view showing the rotating part of the axial seal.
Figure 7:
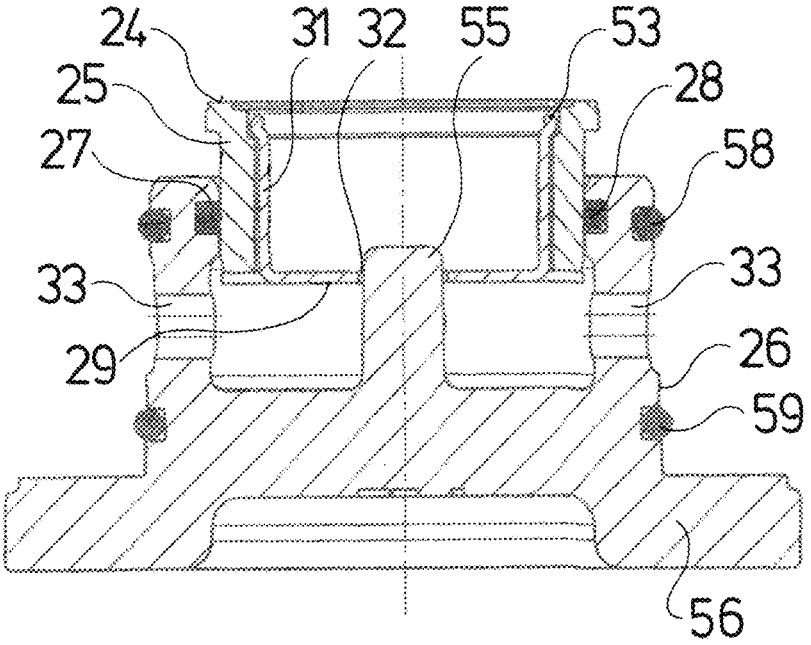
FIG. 7 is an exploded view of the non-rotating part of the axial seal with a holding ring for integration into the pump casing.
Figure 6:
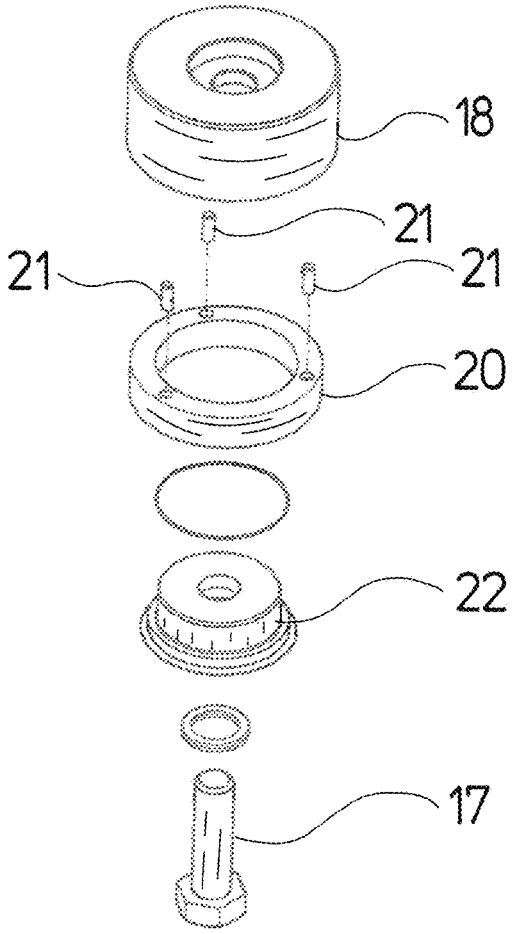
FIG. 6 is an exploded view of the components of the rotating part of the axial seal.
Figure 8:
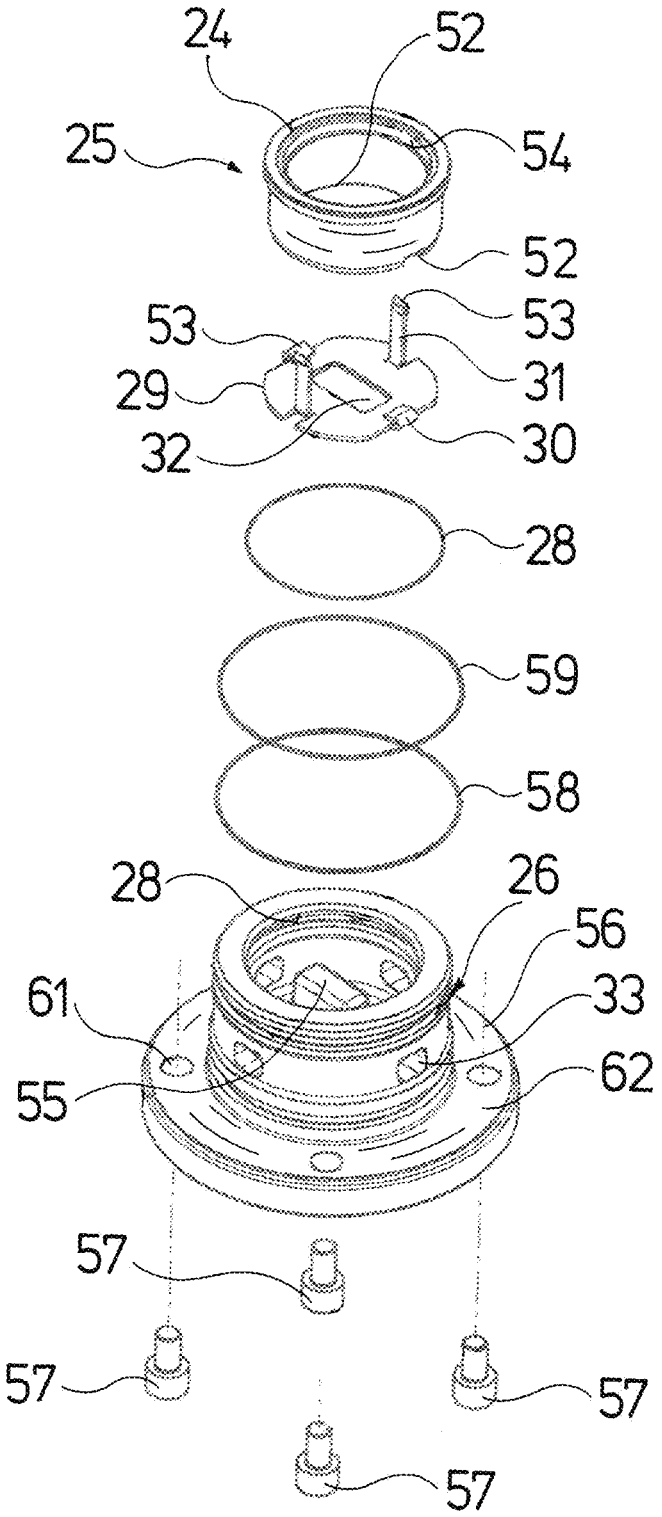
FIG. 8 is an exploded view of the components of the non-rotating part of the axial seal.

With the centrifugal pump which is represented by way of FIGS. 1-10 it is the case of a multi-stage centrifugal pump 1 of the inline construction type which is operated in a standing manner. The pump casing comprises a foot part 2, a head part 3 and a cylindrical jacket 4 which is arranged therebetween and which surrounds the pump stages and is clamped between the head part 3 and the foot part 2. The foot part 2 comprises a suction connection 5 as well as, aligned to this, a delivery connection 6. The head part 3 is designed as a motor stool and surrounds a coupling 7 which connects a shaft 51 of an electric motor 50 schematically represented in FIG. 1 and attached on the head part 3, to a shaft 8 of the pump 1 in a rotationally fixed manner. The shaft 8 of the pump 1 carries the impellers 9 of the pump stages and is rotatably arranged within the pump casing. A radial seal 10 is provided in the head part 3, and an axial seal 11 is provided in the foot part 2. The construction of this axial seal 11 is evident in detail from the FIGS. 3 to 8 and is described in a detailed manner further below. Fluid is brought into the pump casing on operation via the suction connection 5, when the shaft 8 rotates, and this fluid enters into the suction port 12 of the first pump stage and is delivered through the pump stages which are formed in each case by an impeller 9 and a surrounding diffuser 13, until it exits from the last pump stage in the head part 3 and is led back via an annular channel 14 to the delivery connection 6, through which the fluid leaves the pump again.

The casing-side shaft end 15 of the pump in the region of the suction port 12 lies below the first pump stage. It comprises a pocket-hole bore 16 which is provided with a thread and in which a cap screw 17 is seated, with which cap screw a holding ring 18 is sealingly and fixedly fastened on the shaft end 15. The holding ring 18 comprises a wall 19 which is directed to the suction port 12 and is closed with the exception of a central recess for leading through the screw 17, thus is configured in a pot-like manner and is fixedly connected to the shaft end 15 in a sealed manner.

The holding ring 18 is configured as a turned part, is stepped to the side which is away from the shaft end 15 and is formed with a peripheral groove which is open to the bottom and which is provided for receiving a rotating ring 20. The rotating ring 20 consist of silicon carbide and is rotationally secured in the holding ring 18 by way of pins 21 and is otherwise fastened together with the holding ring 18 on the shaft end 15, by way of a sleeve 22 which radially encompasses the rotating ring 20 on the inner side and by way of the screw 7. The rotating ring 20 comprises a downwardly directed axial surface 23 thus which is directed away from the shaft end 15 and this surface forms the rotating axial surface of the axial seal 11. This axial surface 23 is not completely planar, but comprises three macroscopic prominences which are uniformly distributed over the periphery and which on the one hand form a defined contact on the counter-surface 24, which is to say on the axial surface 24 of the non-rotating axial seal part 25, and on the other hand serve for the rapid build-up of the lubricative film. The axial surface 24 is configured in a planar manner and is part of the non-rotating part, here of the ring 25 which is arranged in an axially movable manner within a holding ring 26 integrated in a corresponding receiver in the lower side of the foot part 2 of the pump casing.

The holding ring 26 comprises a peripheral groove 27 on its inner side, in which groove an O-ring 28 is integrated, said O-ring radially sealing the ring 25 with respect to the holding ring 26 and thus with respect to the pump casing. The holding ring 26 is moreover yet sealed with respect to the receiver in the pump casing by way of an outer-peripheral seal 58, as is evident from the sectioned representations 4 and 7.

The non-rotating ring 25 at the rear side which is away from the axial sealing surface 24 is covered by a sheet metal section 20 which almost completely covers this rear side of the sealing ring 25. The sheet-metal section 20 comprises bent-over tongues 30, with which the sheet metal section is integrated within corresponding recesses 52 on the rear side of the ring 25 with a positive fit. These tongues 30 project radially beyond the ring 25 and engage into these recesses 52 in the ring 25 and form part of a rotation lock of the non-rotating ring 25. Moreover, the sheet-metal section 29 comprises two diametrically opposite tongues 31 which are offset by 90° to the tongues 30 and which are bent away upwards out of the plane of the main material by 90° and connect the sheet-metal section 29 in an axially distanced manner to the ring 25, in which the ends 53 engage into a shoulder 54 on the inner side of the ring 25 in a locking manner.

The sheet-metal section 29 forms a closed surface of the lower side of the ring 25 and comprises a central rectangular recess 32, into which a pin 55 which is rectangular in cross section engages, said pin forming part of the holding ring 26, on which the ring 25 comprising the axial sealing surface 24 is guided in a rotationally fixed, but axially movable manner. The pin 55 and the recess 32 with regard to cross section are dimensioned such that this recess 32 with the pin 55 located therein, together with any gap tolerances of the sheet-metal section 29 form a through-gap with a cross-sectional area which is significantly smaller than the cross-sectional area of channels 33 which are provided in the foot part 2 of the pump casing or in the holding ring 26 and which ensure that the interior 34 of the ring 25 with the sheet-metal section 29 and the holding ring 26 is subjected to the pressure of the delivery side of the pump, thus to the pressure at the delivery connection 6. These channels 33, on starting up the pump after an effected pressure build-up ensure that the sheet-metal section 29 with the ring 25 bearing thereon is firstly subjected to force and is pushed, in the direction of the free shaft end, thus towards the motor, since firstly fluid must flow via the smaller cross section of the gap between the recess 32 and the pin 55, into the space enclosed by the ring, before a corresponding counter-pressure is built up. The ring 25 is moved axial upwards in FIG. 1, which is to say is moved axially within the holding ring 26 by way of this, until the axial surface 24 bears on the counter-surface 23, by which means a separation between the suction-side space in the region of the shaft end 15 and the installation space 34 of the stationary part of the axial seal 11 is then also formed. The pressure of the delivery side also prevails within the ring 25 and this at the face side of the shaft 8, as soon as the space which is enclosed by the ring 25 and the sheet-metal section 29 has filled via the gap of the recess 32, by which means the certain force compensation with regard to the hydraulically caused axial force of the shaft 8 and which is desired on operation is effected.

Figure 9:
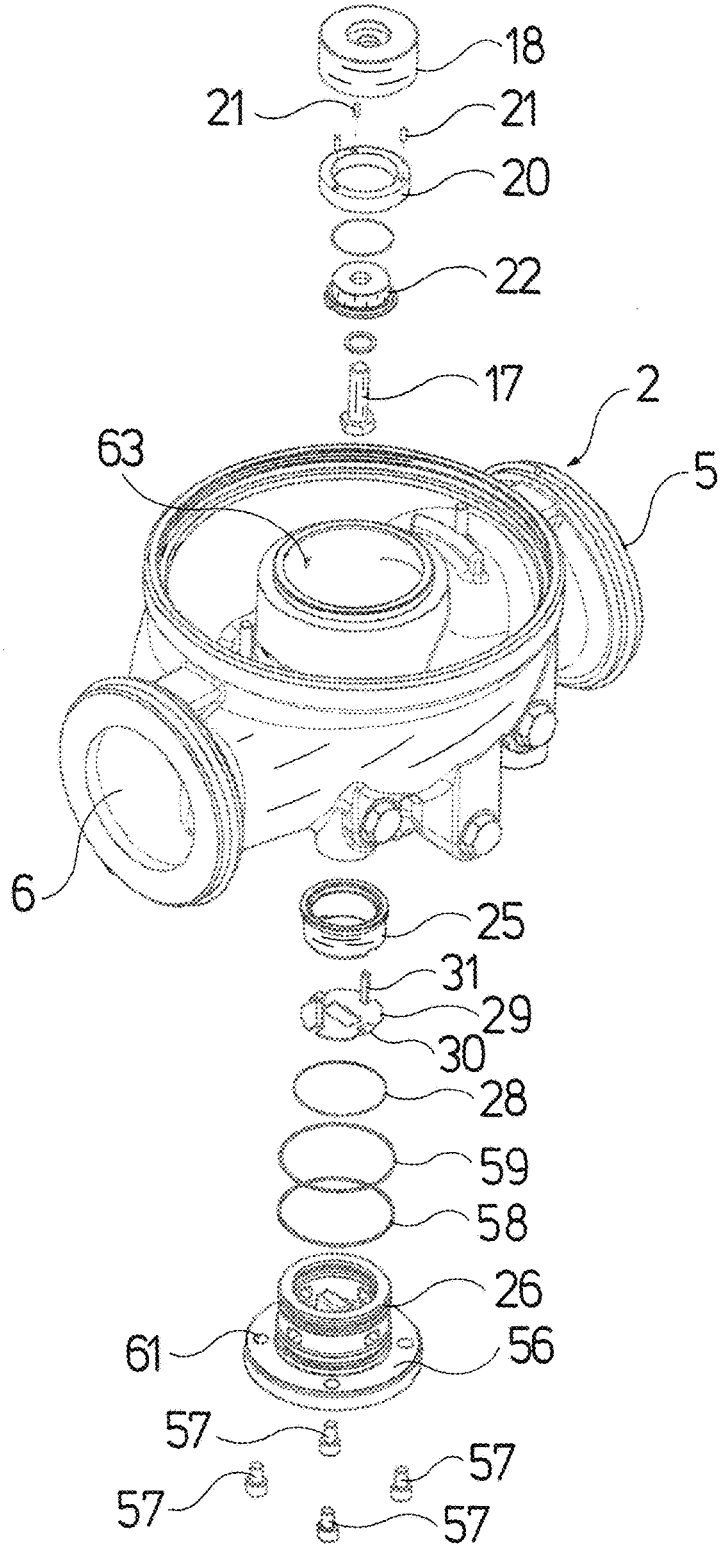
FIG. 9 is an exploded view of the axial seal and the foot part of the centrifugal pump.
Figure 10:
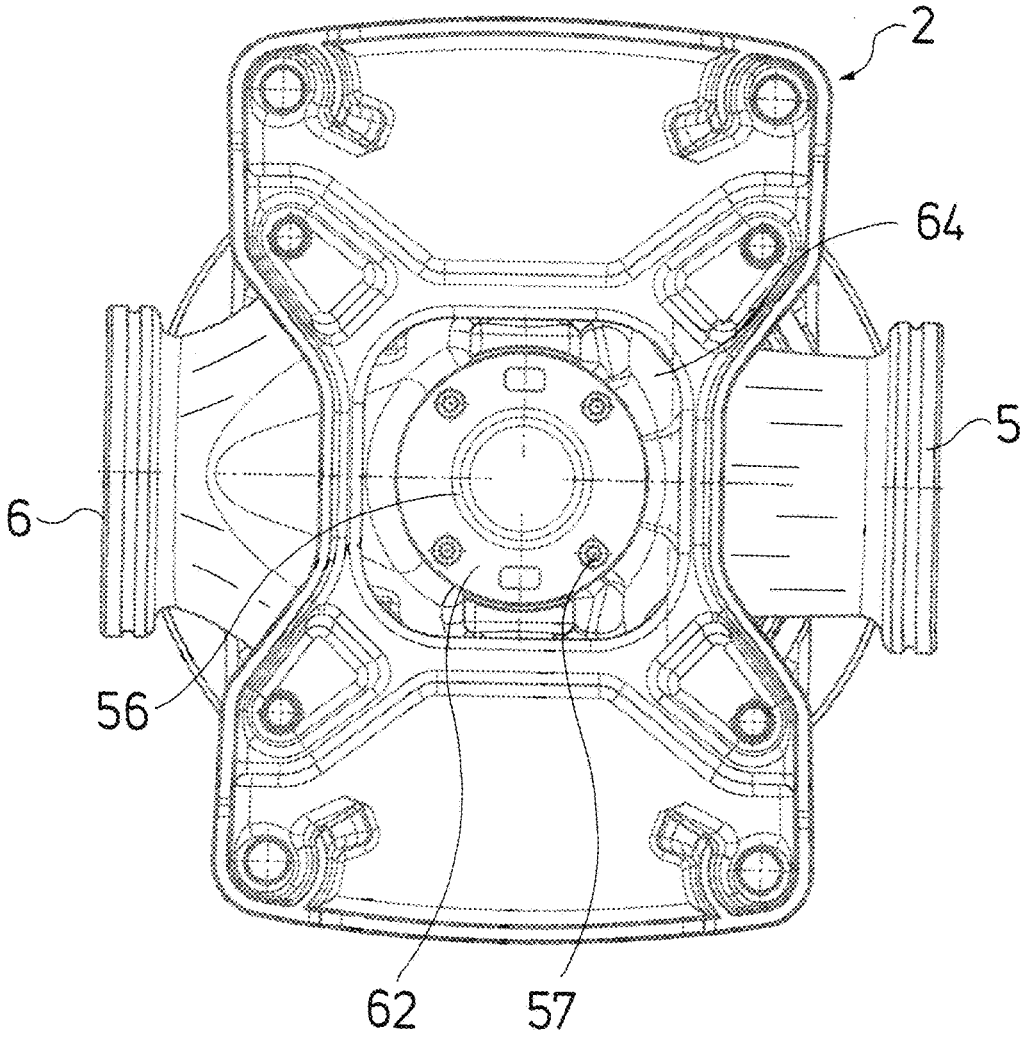
FIG. 10 is an enlarged view of the centrifugal pump from below.

As can particularly be deduced from FIG. 9, the holding ring 26 is part of a circular disc 56 which is provided for integration in a base-side maintenance opening 60 of the pump casing, here of the foot part 2. The disc 56, in a manner closing this base-side opening 60, lies in a shoulder 64 on the lower side of the foot part 2 and is releasably connected to the foot part 2 via four screws 57 which are led through recesses 61 in the edge 62 of the disc 56. An O-ring 58 which is integrated in a peripheral radial groove of the ring 26 and serves for sealing this component with respect to a recess 63 in the foot part 2, is arranged in the upper region of the ring 26, thus at a small distance to the disc 25, for sealing with respect to the foot part 2. A second O-ring 59 is integrated at an axial distance to this, in a peripheral, radial groove in the lower part of the ring 26 and serves for sealing with respect to the maintenance opening 60 in the foot part 2. A connection to the delivery side of the centrifugal pump 1 which is connected in a fluid-leading manner to the interior of the ring 26 via channels 33 in the ring 26, connects within the foot part 2, between the O-rings 58 and 59, so that the pressure of the delivery side via this connection is present at the surface of the non-rotating part 25 of the axial seal, said surface being formed by the sheet-metal section 29 and at the beginning being pressure-effective. The ring 26 via the O-ring 28 lying in a groove on the inner side of the holding ring 26 is sealed with respect to the ring 25 which forms the non-rotating part of the axial seal with the axial surface 24 of the seal. This O-ring 28 thus forms a radial seal which however only has to accommodate the comparatively small movements in the axial direction and therefore is only subjected to a low wear.

The axial seal can be overhauled and exchanged as the case may be, by way of removing the disc 56 with the holding ring 26 which is located thereon, after the screws 57 have been released, due to the fact that the pump casing at the lower side, thus in the base of the foot part 2, comprises a maintenance opening 60 which is closed by the disc 56. The shaft 38 of the pump does not have to be removed for this. All components of the axial seal which are represented in the exploded representation according to FIG. 9 can be exchanged through the opening 61 in the base of the foot part 2. An exchange of the components comprising the axial surfaces 23 and 24 as well as of the O-ring 28 is effected in the simplest case. The shaft 8 in the region of the motor stool has a cross-sectional profile which permits a locking of the shaft by way of laterally engaging a tool, in order to be able to release the threaded connections which are connected to the shaft 8. Thus, the cap screw 17 can be released after the shaft 8 is held in a rotationally fixed manner by way of a spanner introduced in the region of the motor stool, and this screw can then be tightly screwed again after exchange of the rotating ring 20 and, as the case may be, further seals of the holding ring 18.

The axially stationary part of the seal, thus the non-rotating ring 25 with its seals and the holding ring 26 which with the disc 56 forms the cover for closure of the casing opening of the maintenance opening 60, together with the cover 56 are pulled out downwards and thereby the upper part of the holding ring 26 with the peripheral O-ring 58 is pulled out of the recess 63, and the lower part of the holding ring 26 with the O-ring 59 is pulled out of the maintenance opening 60. These seals as well as the O-ring 28 and the non-rotating part of the axial seal 25 can then be exchanged and together are inserted from below into the maintenance opening 60 or the recess 63 of the foot part 2, until the upper part of the holding ring 26 with the O-ring 58 sealingly bears in the recess 63 and the lower part with the O-ring 59 sealingly bears in the maintenance opening 60.

While specific embodiments of the invention have been shown and described in detail to illustrate the application of the principles of the invention, it will be understood that the invention may be embodied otherwise without departing from such principles.

APPENDIX

List of Reference Numerals

1—centrifugal pump
2—foot part

3—head part
4—jacket
5—suction connection
6—delivery connection
7—coupling
8—shaft
9—impellers
10—radial seal
11—axial seal
12—suction port
13—diffuser
14—annular channel
15—shaft end
16—pocket-hole bore
17—cap screw
18—holding ring
19—wall
20—rotating ring
21—pins
22—sleeve
23—axial surface
24—axial surface
25—non-rotating part of the axial seal, ring
26—holding ring
27—groove
28—O-ring
29—sheet-metal section
30—tongues
31—tongues
32—recesses in 29
33—channels in ring 26
34—interior of 25
35—outer thread
36—nut
37—sleeve
37—shaft
50—motor
51—motor shaft
52—recesses in ring 25
53—ends of the tongues 31
54—shoulder in ring 25
55—pin
56—disc/cover
57—screws
58—O-ring
59—O-ring
60—maintenance opening
61—bores for the screws 57
62—edge of cover
62—recess
64—shoulder in foot

What is claimed is:

1. A multistage centrifugal pump comprising:

a pump casing;

a shaft rotatably arranged within the pump casing with one shaft end led out of the casing for connection to a drive motor and another shaft end arranged within the pump casing;

pump stage impellers arranged on the shaft;

a conduit connection to a delivery side of the pump, wherein the shaft end which is arranged within the pump casing is subjected to a counter-force which is produced by way of pressure subjection via the conduit connection;

an axial seal provided on the shaft end arranged within the pump casing, the axial seal having a rotating part that is led on the shaft end which is arranged within the pump casing and the axial seal having a non-rotating and axially movable part that is mounted within the pump casing in an axially movable manner; and a sealing device provided between the pump casing and the axially movable part.

2. A centrifugal pump according to claim 1, wherein the non-rotating and axially movable part of the axial seal is subjected to a pressure of the delivery side.

3. A centrifugal pump according to claim 1, wherein the non-rotating and axially movable part of the axial seal comprises a non-rotating ring with an axial face side forming a sealing surface of the axial seal and with axial side away therefrom is configured closed and comprises at least one recess having a pressure-effective cross-sectional area that is smaller than a pressure-effective cross-sectional area of the conduit connection to the delivery side.

4. A centrifugal pump according to claim 1, wherein sealing device comprises an O-ring held in a radially peripheral groove.

5. A centrifugal pump according to claim 1, wherein an O-ring lies in a groove which is peripheral and on an inner side of a holding ring and which is fixed in the pump casing.

6. A centrifugal pump according to claim 3, wherein the closed axial side of the non-rotating ring comprises a sheet-metal section which covers the non-rotating ring and is connected in a rotationally fixed manner to this and to a holding ring of the non-rotating and axially movable part and/or the pump casing.

7. A centrifugal pump according to claim 1, wherein the rotating part of the axial seal comprises a holding ring which is sealingly and fixedly connected to the shaft end and which carries a rotating ring forming an axial sealing surface.

8. A centrifugal pump according to claim 7, wherein the rotating ring is positively fixed on the holding ring by way of a sleeve which is integrated into the holding ring.

9. A centrifugal pump according to claim 1, wherein the pump casing comprises a suction connection and a delivery connection, and a channel is provided within the pump casing, said channel connecting the delivery connection to a space which receives the non-rotating part of the axial seal.

10. A centrifugal pump according to claim 9, wherein the suction connection and the delivery connection are arranged on a same axis and transversely to a shaft axis.

11. A centrifugal pump according to claim 1, wherein the rotating part comprises a rotating ring including an axial sealing surface that forms a three-point contact.

12. A centrifugal pump according to claim 1, further comprising motor-side bearing wherein an axial mounting of the shaft is effected by the motor-side bearing.

13. A centrifugal pump according to claim 1, wherein the non-rotating and axially movable part of the axial seal comprises a ring configured as a single-part and comprising a wear-resistant part having a sealing surface as well as a carrier receiving the wear-resistant part.

14. A centrifugal pump according to claim 13, wherein:

the rotating part comprises a rotating ring including an axial sealing surface; and the rotating ring or the wear-resistant part of the ring or both the rotating ring and the wear-resistant part is comprised of silicon carbide.

15. A centrifugal pump according to claim 1, wherein a closable opening, through which the axial seal can be exchanged, is provided in a base of the pump casing, aligned to the axial seal.

* * * * *